US011794472B2

(12) United States Patent
Sherman et al.

(10) Patent No.: US 11,794,472 B2
(45) Date of Patent: Oct. 24, 2023

(54) METHOD AND APPARATUS FOR CONTINUOUS INKJET PRINTING

(71) Applicant: VIDEOJET TECHNOLOGIES INC., Wood Dale, IL (US)

(72) Inventors: Nigel Edward Sherman, Woolpit (GB); Arkadiusz Cezary Zawada, Baldock (GB); David Horsnell, Cambridge (GB); Paul Cox, Stevenage (GB)

( * ) Notice: Subject to any disclaimer, the term of this patent is extended or adjusted under 35 U.S.C. 154(b) by 20 days.

(21) Appl. No.: 17/763,848

(22) PCT Filed: Sep. 24, 2020

(86) PCT No.: PCT/EP2020/076819
§ 371 (c)(1),
(2) Date: Mar. 25, 2022

(87) PCT Pub. No.: WO2021/058699
PCT Pub. Date: Apr. 1, 2021

(65) Prior Publication Data

US 2022/0332109 A1 Oct. 20, 2022

(30) Foreign Application Priority Data

Sep. 26, 2019 (GB) ..... 1913889

(51) Int. Cl.
*B41J 2/07* (2006.01)
*B41J 2/02* (2006.01)

(52) U.S. Cl.
CPC . *B41J 2/07* (2013.01); *B41J 2/02* (2013.01); *B41J 2002/022* (2013.01)

(58) Field of Classification Search
CPC ..... B41J 2/12; B41J 2/125; B41J 2/13; B41J 2002/022; B41J 2/075; B41J 2/08;
(Continued)

(56) References Cited

U.S. PATENT DOCUMENTS 4,496,954 A 1/1985 Irwin
4,746,929 A 5/1988 Lin et al.
(Continued)

FOREIGN PATENT DOCUMENTS

JP 2013010229 A 1/2013
WO 2014156297 A1 10/2014

OTHER PUBLICATIONS

PCT/EP2020/076819 International Search Report and Written Opinion, dated Jan. 11, 2021, 22 pages.
Search Report for GB1913889.0, dated Mar. 24, 2020, 5 pages.

*Primary Examiner* — Kristal Feggins
(74) *Attorney, Agent, or Firm* — Wolter Van Dyke Davis, PLLC; Robert L. Wolter

(57) ABSTRACT

A method of processing phase signals for continuous inkjet printing, said method comprising: providing at least one phase signal, wherein said at least one phase signal is an analogue signal; converting the at least one phase signal into at least one corresponding digitised phase signal; and processing said at least one digitised phasing signal, wherein the processing comprises extracting at least one predetermined phase parameter from the at least one digitised phasing signal when the at least one digitised phasing signal is a time-domain digitalised phase signal, and wherein the at least one predetermined phase parameter comprises one or more time-domain signal features of the at least one digitised phasing signal.

20 Claims, 9 Drawing Sheets

(58) Field of Classification Search
CPC ..... B41J 2/085; B41J 2/09; B41J 2/095; B41J 2/10; B41J 2/04505; B41J 2/04563; B41J 2/04553; B41J 2/04555; B41J 2/14145; B41J 2/14153; B41J 2/14024; B41J 2/04508; B41J 2/04513; B41J 2/04515
See application file for complete search history.

(56) References Cited

U.S. PATENT DOCUMENTS

| | | | | |
|---|---|---|---|---|
| 6,561,614 | B1 * | 5/2003 | Therien | B41J 29/393 347/19 |
| 2003/0184620 | A1 * | 10/2003 | Shrivastava | B41J 2/09 347/77 |
| 2005/0280676 | A1 * | 12/2005 | Rybicki | B41J 2/125 347/76 |
| 2007/0064037 | A1 | 3/2007 | Hawkins et al. | |
| 2012/0182362 | A1 * | 7/2012 | Odin | B41J 2/125 347/81 |
| 2013/0057904 | A1 | 3/2013 | Soto et al. | |

* cited by examiner

METHOD AND APPARATUS FOR CONTINUOUS INKJET PRINTING

The invention relates to a method of processing phase signals for continuous inkjet printing. The invention also relates to apparatus for implementing said method; and to continuous inkjet printers, such as multi-jet printers or binary array printers. The invention also relates to computer programmes, and related physical media for storing said programmes, for implementing said method on a computer, or on said apparatus and/or printers.

The phase signals or phasing signals, it will be understood, are signals suitable for performing phasing in continuous inkjet printers. These are signals, such as waveforms, representative of characteristics related to the formation of ink droplets (and in particular charged ink droplets) from one or more continuous ink jets, and/or to their travel onto a printed substrate.

Continuous inkjet printing is an established technique for marking information on rapidly moving substrates in industrial environments such as production lines. Although such arrangements usually comprise a fixed printer and moveable substrate, the reverse is also in principle possible.

One or more continuous ink jets are emitted by corresponding one or more printing nozzles located on a printhead. The printhead is in fluid communication with an ink reservoir which contains ink of a suitable composition. In multi-jet applications a plurality of nozzles and/or orifices each corresponding to an ink jet may be provided. The printing orifices, and thus the ink jets, may be arranged as an array. In binary array printers, the spacing of the ink jets in the array determines the horizontal and/or vertical resolution of the printhead. It will be apparent that different applications may require different printhead resolutions.

Vibration is applied to the one or more ink jets typically by one or more piezoelectric elements suitably disposed in, and coupled with, parts of the printhead and/or the nozzles individually. In use, the ink jets are caused by the vibration to break off into discrete droplets of ink which may be selectively charged so that they can be selectively deflected downstream of the nozzle(s), on their travel to the printed substrate, by an electric deflection field generated by, usually, corresponding deflection plates. The arrangement is such that, typically, the charged droplets are deflected into a gutter and, from there, returned to the ink reservoir, whereas the uncharged droplets are printed onto the moving substrate. Such arrangements are known as binary arrays since only non-charged ink droplets are printed.

It is important to monitor the formation and/or travel of the droplets to perform satisfactory printing. For example, it may be important to determine the point (which may be expressed in time and/or space, in absolute and/or relative terms, with reference to an individual ink jet or to multiple ink jets etc.) at which the droplets detach from the ink jets. This information may then allow the droplets to be correctly charged by means of one or more charge electrodes associated with the one or more nozzles and/or orifices. If the electric field is applied too early to the charge electrode before the droplet detaches from the ink jet, the charge temporarily induced on the droplet by the electric filed will dissipate in the ink jet. If the electric field is applied too late, the charge will no longer form on the droplet.

One or more sensors are therefore also usually provided in the printhead arrangement to detect the formation of the droplets, and particularly the charged droplets, and determine, as required, one or more parameters associated with the droplets such as their time of flight, size, speed or charge.

Generally, any one or more of these parameters are referred to as the phase data (or phase parameters), and these sensors are accordingly referred to as the phase sensors. Different types of phase sensors can be adopted. Separate phase sensors can be provided for each ink jet, or common phase sensors may measure droplets emitted from a plurality of orifices.

Commonly used phase sensors may be in the form charge-pickup electrodes. Such sensors may be disposed, for example, at an outlet of a drop generation module included in the printhead. The charge-pickup electrode senses the charge associated with a (charged) transiting droplet and thus provides a corresponding phase signal usually in the shape of a phase waveform. These phase signals and/or waveforms may be correlated to each other for multiple jets, or, for example, they may be referred to the modulation waveform used for actuating the piezoelectric elements to extract the required phase data. Different manners of processing the phase signals to extract the required phase data are possible. However, the phase data usually comprise the phase relationships between different jets emanated from the same printhead, and the phase relationship between the jets and the modulation waveform.

The invention provides an improved phasing method and apparatus for continuous inkjet printing.

According to an aspect of the present invention, there is provided a method of processing phase signals for continuous inkjet printing, said method comprising:

- providing at least one phase signal, wherein said at least one phase signal is analogue;
- converting the at least one phase signal into at least one corresponding digitised phase signal; and
- processing said at least one digitised phasing signal.

Converting the at least one phase signal into at least one corresponding digitised phase signal may be carried out by one or more analogue-to-digital (A/D) converters. The one or more A/D converters may be stand-alone components or units, or may be integrated into larger components or units.

Advantages that may be expected from, or are at least may be enabled by, providing at least one digitised phase signal, or digitised phase waveform, according to the present invention, are:

(i) ease of processing the digitised phase signals to extract the required phase data or phase parameters, even at low or very low signal-to-noise ratios, such as those that may be experienced due to crosstalk between different nozzles in multi-jet printheads, or due to the high voltage supplied to the deflection electrode;

(ii) simplified electronics for phasing, with a reduced cost; and, (iii) improved computational speed, especially since time-transient phase signals and waveforms can then be used quickly and efficiently in the digitised, i.e. discrete, domain to extract the required phase data, and with less computational effort and potentially no requirement to await for stabilisation in time of the phase signals.

Processing the at least one digitised phasing signal may comprise extracting at least one predetermined phase parameter from the at least one digitised phasing signal when the at least one digitised phasing signal is a time-domain digitalised phase signal. The at least one predetermined phase parameter may comprise one or more time-domain signal features of the at least one digitised phasing signal. The one or more time-domain signal features may comprise any one or more of: a peak; a trough; a threshold; a derivative; a differential; an integral; a power; an average; and a window.

In preferred embodiments, the phase signal is a time-domain phase signal, such as a time waveform. Accordingly, the at least one digitised phase signal may be a time-domain digitised phase signal. Time domain processing may make it easier to cancel out or reduce any background noise, e.g. from crosstalk in multi-jet printheads or from the high-tension deflection electrodes.

For example, the use of a digitised time-domain signal allows accurate identification of 'windows' in which a signal value should be processed and assessed. A signal obtained within such a processing window, may be compared to a reference signal obtained at another time. Periodic features of the signal may be readily identified, and information relating to the period used to allow effective periodic noise cancelation. Additionally, time-domain processing permits the identification of particular characteristic signal shapes within a waveform (whether desirable or otherwise).

Advantageously, the time domain processing of the phase signals (which observes the behaviour and evolution of the phase signals or waveforms in time) may allow certain time domain signal models to be applied to the measured phase signals to extract the required signal features. For example, it may be possible detect the partial blockage of a nozzle, and/or a misdirection in a jet of an array in this way.

In preferred embodiments, the method may further comprise pre-processing said at least one digitised phase signal. Said pre-processing said at least one digitised phase signal may comprise conditioning the at least one digitised phase signal. Said pre-processing may comprise conditioning the at least one digitised phase signal according to any one or more of the following digital signal conditioning operations: filtering; smoothing; rectifying; averaging; amplifying; and/or gating. Said digital signal conditioning operations can be advantageously performed in the time domain, i.e. without needing to first transform the signals into the frequency domain.

Said pre-processing may comprise generating an averaged phase signal, said generating comprising averaging the digitised phase signal so as to remove signal components above a predetermined cut-off frequency Said cut-off frequency may be based on a droplet generation frequency. Said cut-off frequency may be greater than or equal to a droplet generation frequency.

Said pre-processing may comprise generating a modulation averaged phase signal, wherein said modulation averaged phase signal comprises a fixed value for each period of a droplet generation modulation signal.

In preferred embodiments, the phase signals may be measured by one or more charge-pickup electrodes arranged to sense charged ink droplets. Optionally, said phase signals may be representative of a transit of said charged droplets alongside said charge-pickup electrodes.

In preferred embodiments, said processing of the at least one digitised phase signal may comprise extracting one or more predetermined phase parameters. Said predetermined phase parameters may be one or more of: a peak; a trough; a threshold; a derivative; a differential; an integral; a power; an average; a window; and/or any other one or more time-domain signal features. Said predetermined phase parameters may be one or more time-domain signal features when the digitised phase signal is a time domain digitised phase signal.

Embodiments of the present invention may enable additional phase parameters to be extracted which would otherwise not be possible or advantageous to extract when the measured signals are processed in the analogue and/or frequency domains.

The method may further comprise extracting a first phase parameter and extracting a second phase parameter. Said first phase parameter and said second phase parameter may be associated with different sensing periods. A comparison may be performed between said first and second phase parameters. A present and a past phase parameter may thus be compared. In this way changes in the phase signal can be monitored over time.

Existing analogue processing methods typically require analogue signals to be transferred over significant distances (e.g. along a printhead umbilical), making them susceptible to noise. Embodiments described herein, however, may improve the signal to noise ratio, thus enabling smaller signals to be processed successfully, thereby improving the robustness of phase parameter extraction. For example, a measure of jet straightness may be detected in this way.

Said processing the at least one digitised phase signal may comprise identifying a peak in said signal. Said identified peak may correspond to the passage of a droplet past a phasing sensor.

Said method may further comprise generating predetermined phase parameters associated with said identified peak.

Said method may further comprise generating a response value associated with said identified peak, said response value comprising data indicative of a difference between a first amplitude value during said peak and a second amplitude value before and/or after said peak.

The first amplitude value may be a maximum amplitude value. The second amplitude value may be a minimum amplitude value. The second amplitude value may be based on a first minimum value before said peak and a second minimum value after said peak.

Said method may further comprise:

identifying a second peak in said signal;

generating a second response value associated with said second identified peak; and generating a differential response value, said differential response value comprising data indicative of a difference between said response value and said second response value.

Said response value and said second response value may be associated with different sensing locations.

Said response value and said second response value may be associated with the same droplet detected by different ones of a plurality of sensor electrodes.

Said response value and said second response value may be associated with different sensing periods, thereby allowing a comparison to be made between a present and a past response value. In this way changes in the phase signal can be monitored over time.

The method may further comprise generating data indicative of printer performance based upon said response value and/or said differential response value.

Said processing the at least one digitised phase signal may comprise generating data indicative of a droplet break-up location.

Said processing the at least one digitised phase signal may comprise comparing the at least one digitised phase signal to a reference signal, and identifying a difference between said at least one digitised phase signal and said reference signal.

Advantageously, two or more phase signals may be provided each corresponding to a separate printing orifice of a multi-jet printhead.

In some embodiments, two or more analogue phase signals, a plurality of analogue phase signals or a large plurality of analogue phase signals, may be provided. Each phase signal may correspond to an ink jet of a multi-jet continuous inkjet printer.

Said multi-jet continuous inkjet printer may be a binary array printer.

There can be a plurality or a large plurality of nozzle orifices and corresponding phase signals each corresponding to a separate ink jet, each of which may be processed as described herein, by common or separate analogue-to-digital converters as the case may be. The orifices may be arranged to form an array of orifices, for example 16 orifices can be arranged in a row or column, or there could be 128 or 256, or more, orifices arranged within an inch to provide a vertical or horizontal print resolution of 128 dots-per-inch, or more. Fewer or more nozzles and/or orifices than the examples provided above, arranged in a straight line, or in a different configuration, are also possible. Especially in binary array printheads, there will be thousands of charged droplets in flight at any one time which may require 'phasing' so as to result into an acceptable or optimised printing performance. Generally, it may be desirable that different ink drops be emitted by different nozzles at substantially the same time, and travel together, such that they are printed onto the moving substrate at substantially the same time. This may require, as it will be apparent from the description below, the ability to extract phase data at very low signal-to-noise ratios. At least some embodiments of the present invention may achieve or enable this.

Said processing the at least one digitised phase signal may comprise combining data associated with a plurality of digitised phase signals corresponding to a respective plurality of ink jets.

Said combining may comprise generating an average value of said data associated with said plurality of digitised phase signals (e.g. an average response value).

Said processing the at least one digitised phase signal may comprise comparing data associated with a first digitised phase signal corresponding to a first ink jet to data associated with one or more further digitised phase signals corresponding to one or more further ink jets.

Said data associated with a first digitised phase signal and/or said one or more further digitised phase signals may comprise phasing parameters and/or response values.

Said processing may further comprise identifying a difference between said data associated with the first digitised phase signal and said data associated with said one or more further digitised phase signals.

Said data associated with said one or more further digitised phase signals may comprise an average phasing parameter and/or an average response value based upon a plurality of further digitised phase signals.

Said processing the at least one digitised phase signal may comprise generating data indicative of a relationship between a charge electrode property and an ink jet property.

Said relationship may be the extent to which one or more ink jets are parallel to one or more charge electrodes.

Said providing an analogue phase signal may comprise providing a charge-pickup electrode for sensing a charged droplet.

Said charge-pickup electrode may be arranged to provide a phase signal representative of a transit of said charged droplet alongside said charge-pickup electrode.

There is also provided a method of phasing a continuous inkjet printer, a multi-jet printer or a binary array printer comprising a method described herein.

According to a further aspect of the present invention, there is provided apparatus for continuous inkjet printing, the apparatus comprising:

a printhead comprising one or more printing orifices for emitting one or more ink jets;

one or more phase sensors associated with one or more ink jets for generating one or more corresponding analogue phase signals; and at least one analogue-to-digital converter, wherein said at least one analogue-to-digital converter is arranged to convert said one or more analogue phase signals into corresponding digitised phase signals.

Since the digitised phase signals may be easily stored and buffered, e.g. in any number of solid state memories operably associated with the apparatus, embodiments of the present invention comprising at least one memory may enable or facilitate the provision of printer functions such as the monitoring of the run time of the printhead or the automatic set-up of a correct modulation signal. When the digitised phase signals are expressed in the time domain, these may be referred to an absolute clock. This would allow an absolute-time phasing to be performed. For example, absolute-time phasing may enable particular types of ink jet anomalies, such as, for example, skews and minor blockages, to be detected.

The apparatus may further comprise a processor configured to process said one or more digitised phase signals to extract at least one predetermined phase parameter when the one or more digitised phasing signals are time-domain digitalised phase signals. The at least one predetermined phase parameter may comprise one or more time-domain signal features of the digitised phasing signals. The one or more time-domain signal features may comprise any one or more of: a peak; a trough; a threshold; a derivative; a differential; an integral; a power; an average; and a window.

The one or more phase sensors may comprise at least one charge-pickup electrode arranged to sense a charged droplet.

Said charge-pickup electrode may be arranged to sense a transit of said charged droplet alongside said charge-pickup electrode.

The apparatus may further comprise a processor for processing said one or more digitised phase signals to extract one or more predetermined phase parameters.

The printhead may be a multi-jet printhead comprising two or more printing orifices, or a plurality of printing orifices, or a large plurality of printing orifices.

Said printhead may be a binary array printhead having the large plurality of printing orifices disposed as an array.

According to a further aspect of the present invention, there is provided a method of phasing a continuous inkjet printer comprising a method of processing a phase signal for continuous inkjet printing as described herein. There is also provided a method of phasing a multi-jet printer or a binary array printer comprising a method of processing a phase signal for continuous inkjet printing as described herein.

According to a further aspect of the present invention, there is provided a continuous inkjet printer comprising apparatus for continuous inkjet printing as described herein.

According to a further aspect of the invention, there is provided a computer programme for programming a computer to implement a method as described herein. Said method can be performed on an apparatus or an inkjet printer as described herein. The computer programme may be stored on suitable media such as a CD, as server or on a solid state memory.

Embodiments of the present invention may also provide more reliable phase data compared to the prior art.

Embodiments of the present invention may also provide methods and apparatuses which are more easily portable or customisable between single and multi-jet continuous inkjet printer platforms compared to the prior art.

Embodiments of the present invention may also provide or enable apparatuses which are more compact or packageable compared to the prior art, for example to better suit different charge electrode geometries.

It will be appreciated that features described in combination with any one of the above aspects of the invention may be combined with any other aspect of the invention described herein, unless it would be clearly impossible to do so.

Further features and advantages of the present invention will be clear from the appended claims.

The invention will now be described, purely by way of example, in connection with the appended drawings in which.

Figure 8A:
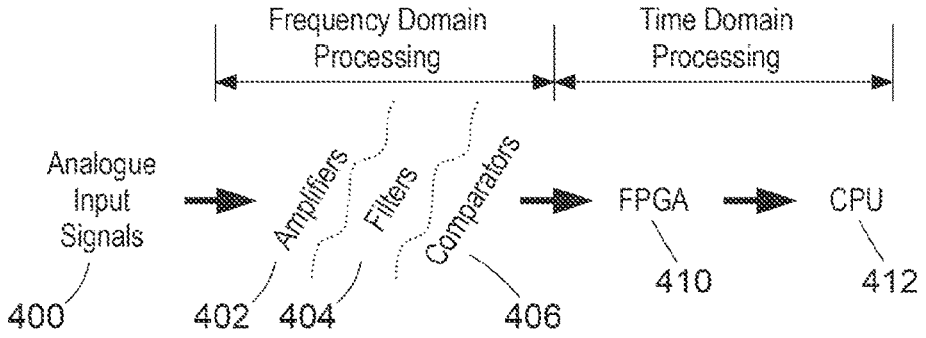
Figure 8B:
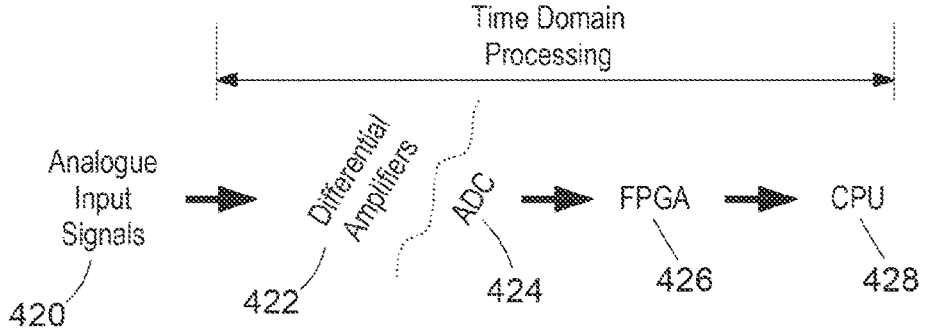
Figure 9:
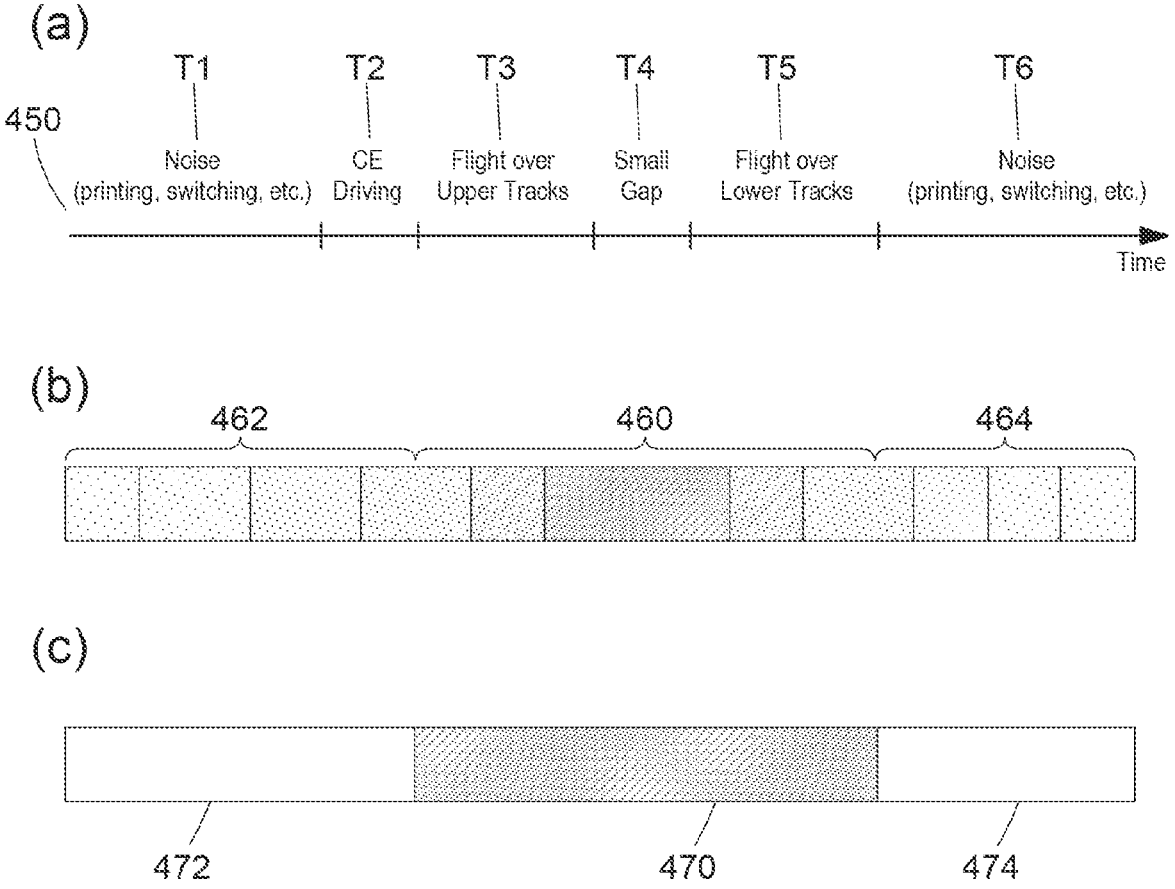
Figure 10:
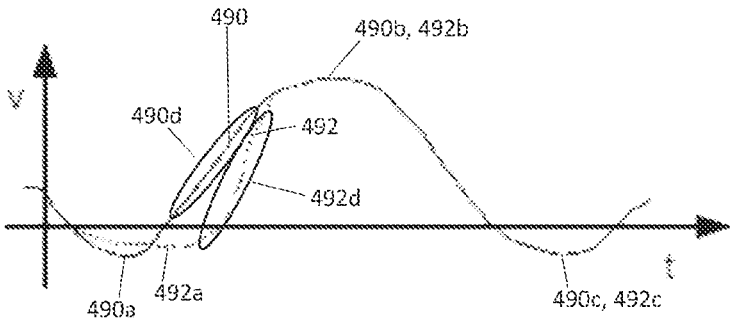

FIG. 8*a* is signal flow diagram representing a prior art method of processing a phase signal;

FIG. 8*b* is signal flow diagram representing a method of processing a phase signal according to the invention;

FIG. 9 shows (a) a timeline and processing of signals obtained and processed according to (b) prior art techniques and (c) the invention;

FIG. 10 shows signals obtained by a method of the invention; and

Figure 11A:
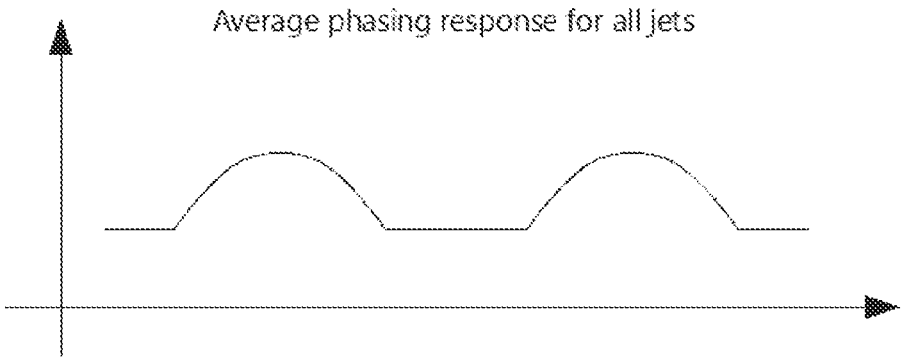
Figure 11B:
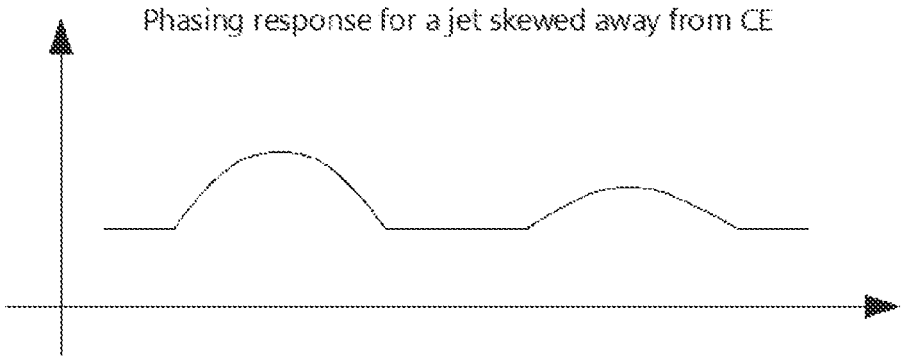
Figure 11C:
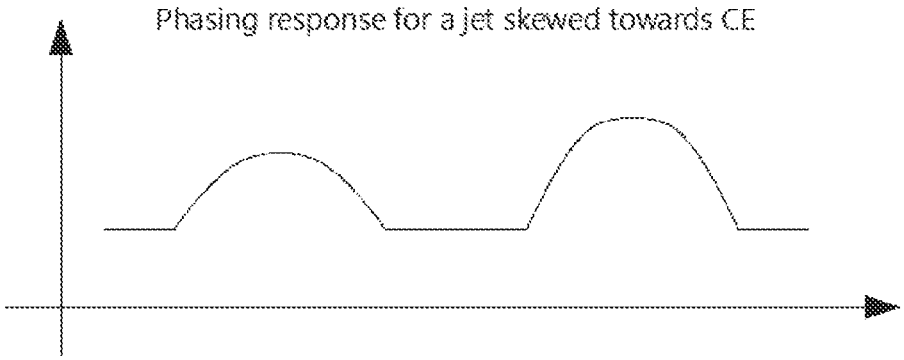

FIGS. 11*a* to 11*c* illustrate phase responses in parallel and non-parallel jets.

Figure 1:
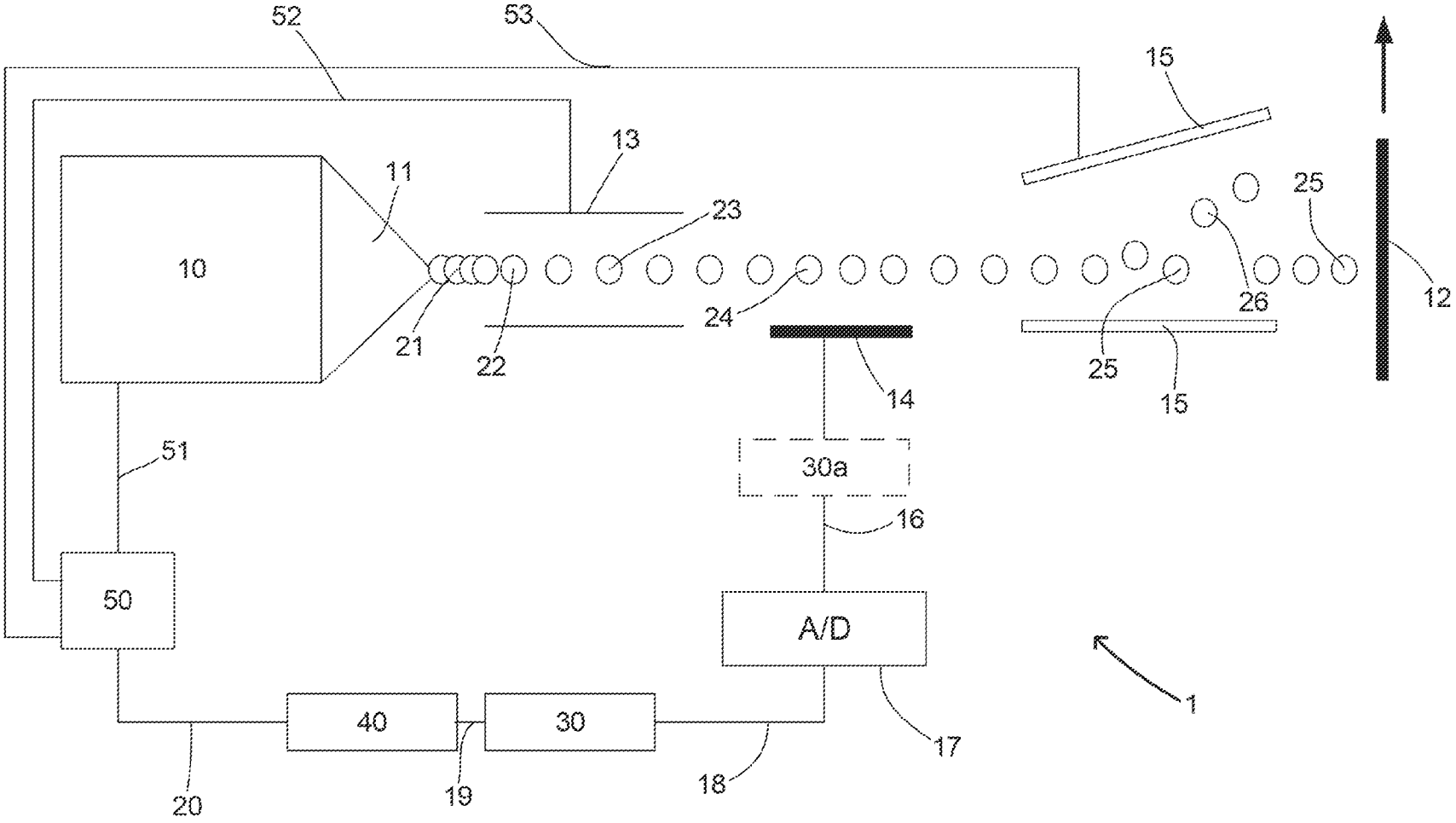
FIG. 1 is a schematic representation of a multi-jet continuous inkjet printing apparatus according to an embodiment of the present invention.

A printhead 10 of a continuous inkjet printer 1 is schematically represented in FIG. 1. The printhead 10 has at least one nozzle 11 for generating ink droplets 22, 23, 24, 25, 26 from a continuous stream of ink 21 (also schematically represented in FIG. 1 as a set of overlapping droplets). Various droplet formation processes and printhead designs are possible, typically comprising one or more electromechanical actuators, such as piezoelectric elements, converting an electrical signal (the modulation signal) into mechanical vibration which is responsible for generating areas of low pressure in the ink stream 21, thereby triggering the formation of the ink droplets 22, 23, 24, 25, 26. These components and mechanisms are described in the art, and will not be described further herein.

The ink droplets 22, 23, 24, 25, 26 are routed through a charge electrode 13 for selectively acquiring charge. An electric field is selectively applied to the charge electrode 13 at appropriate times, and at appropriate magnitudes, to induce a required charge on the selected droplets 23, 26. The other droplets 24, 25 remain electrically neutral, or have acquired a smaller or negligible amount of charge. In this described embodiment, the charged droplets 23, 26 are deflected by an electric deflection field applied between deflection plates 15, and collected into a gutter system (not shown) for return to an ink reservoir (also not shown) in fluid communication with the printhead 10. The uncharged droplets 24, 25 are printed onto a moving substrate 12. Various designs and arrangements for the charge electrode 13, deflection plates 15, and the moving substrate are possible, and one related to a binary array printhead will be described in further detail below in connection with FIGS. 3-6. In an embodiment, a single earthed deflection plate 15 is used, which acts to cause charged droplets to be deflected towards the gutter system.

Provided between the charge electrode 13 and the deflection plates 15 is a phase sensor 14. In this embodiment, the phase sensor 14 detects the transit of the charged droplets 23, 26. It will be understood that the phase sensor 14 could be provided at a different location, for example downstream of the deflection plates 15, between the deflection plates 15 and the moving substrate 12 or in proximity of the gutter system (not shown). It will also be understood that different phase sensors 14 to those described herein may be employed insofar as they are capable of detecting characteristics associated with the ink droplets and related to their formation and/or travel. A plurality of phase sensors may be used, as it will be described further below in connection with FIGS. 3-6. Further, it is also possible to use phase sensors in combination, for example to measure the time of flight of the ink droplets between the phase sensors.

The purpose of the phase sensor 14 is to sense the transit of the charged droplets 23, 26 by detecting the charge present on the charged droplets 23, 26 when the charged droplets 23, 26 travel in proximity and alongside the phase sensor 14, and to generate an analogue phase signal representative of said transit—the phase signal. The phase signal is then processed by appropriate circuitry 17, 30, 40 and the results inputted to a controller 50 that controls the generation of the ink drops from the printhead 10, and the generation of the electric fields in the charge electrode 13 and the deflection plates 15, respectively.

Phase signals are of importance in continuous inkjet printing applications, since they allow users to monitor and optimise the printing performance. For example, if the charge induced on the droplets is below the required amount, this can be corrected. In multi-jet or binary array printing, it may be important to phase the individual nozzles so that a row of to-be-printed droplets emitted at substantially the same time by the array are printed onto the travelling substrate substantially simultaneously.

To induce a charge on a selected droplet 22, the charge electrode 13 applies an appropriate electric field at the correct time, i.e. when the selected droplet 22 breaks off from the continuous inkjet stream 21 as schematically depicted in FIG. 1. The relationship between the break-off time and the time at which the selected droplet 22 transits by the phase sensor 14, which relationship can be expressed in terms of time or space, is a phase relationship between the charge electrode 13 and the charged droplets 23, 26. This phase relationship can vary, in use, due to various, potentially unpredictable, factors, such as variations in ink composition, variations in the coupling of the piezoelectric elements with the nozzles, manufacturing tolerances, temperature ageing and usage. Thus, knowledge (and control, based on such knowledge) of this phase relationship can be important for a successful inkjet printing performance and effort has traditionally been spent in devising improved phasing systems and methods. It will be appreciated that different phasing relationships may be used and made the subject of the phasing process. For example, it may be desirable to phase multiple ink jets emitted by a multi-jet printhead 10; or, the deflection electric field with the passage of the charged droplets 23, 26; and/or, the deflection electric field with the break-off time of the droplets 22. Phase relationships also exist, for example, between the modulation signal and the transit of the charged droplets 23, 26 in front of the phase sensor 14. Any of the above phase relationships, or others, may be the subject of the phasing processes described herein.

The processing of measured phase information has traditionally been done (probably due to the high level of reliability and accuracy required to achieve satisfactory inkjet printing performance) using analogue phase signals and analogue circuitry. The present invention arises from the appreciation that digital capabilities enable the phase signals to be accurately and advantageously digitised for ease of processing while maintaining reliability and accuracy in the phase data. In other words, the inventors have appreciated that there was a bias in the relevant arts towards analogue phasing and that it was possible to remove this prejudice. Analogue-to-digital (A/D) converters, as standalone components or as part of larger circuits, such as integrated circuits, may achieve sampling rates and vertical resolutions which warrant their use in applications such as the processing of phase signals for inkjet printing.

Accordingly, as shown in FIG. 1, an analogue phase signal detected by the phase sensor 14 is communicated via a first communication line 16 to an A/D converter 17. The A/D converter 17 converts the analogue phase signal measured as show in FIG. 1 into a digitised phase signal. It will be understood that appropriate sampling rates and vertical resolutions can and will be selected by the skilled person depending on specific printing applications, and there is accordingly no requirement to discuss these in detail in the present disclosure.

The digitised phase signal is communicated via a second communication line 18 to a pre-processor 30 for pre-processing. Pre-processing may comprise a number of signal conditioning operations which will be known to the person skilled in the art, such as filtering, smoothing, amplifying, averaging etc. . . . . It is not necessary to supply any further details of such known techniques. Analogue pre-processing of the analogue phase signals may also possible in some embodiments, as shown by the alternative location of pre-processor 30*a* shown in dashed line in FIG. 1.

Advantageously, whereas traditionally the pre- and/or post-processing of the phase signals have been carried out in the frequency domain, in the embodiments described herein the digitised phase signals are pre-processed in the time domain.

The pre-processed digitised phase signal is communicated to a processor 40 via a third communication line 19 so that the processor 40 can extract any monitored features (i.e. the phase data), as required. Application-specific algorithms for extracting the phase data from the digitised phase signals are not described herein.

The post-processing of the digitised phase signals in the processor 40 is also carried out in the time domain in the embodiment shown in FIG. 1. Preferred embodiments of the invention, therefore, prescribe pre- and/or post-processing of the digitised phasing signals in the time domain. Accordingly, there will generally no longer be the need for any analogue phasing signals to stabilise in time prior to processing, as any transient time signals can still be usefully analysed in the time domain to extract the required phase parameters.

Via a fourth communication line 20, the processed phase data are sent to a controller 50. The controller 50 receives the phase data and implements a control strategy. The control strategy is communicated: via a fifth communication line 51 to the printhead 10, which controls the formation of the ink droplets 22, 23, 24, 25, 26 emitted by the nozzle 11; via a sixth communication line 52 to the charge electrode 13, which controls the charging of the droplets 23, 26; and, via a seventh communication line 53, to the deflection plates 15, which control the return of the charged droplets 23, 26 to the ink reservoir. The control strategy, based on the phase data obtained via the digital circuitry 30, 40 shown in FIG. 1, is responsible for a correct printing performance. Various control strategies are described in the art, and are not therefore discussed herein in further detail.

Figure 2:
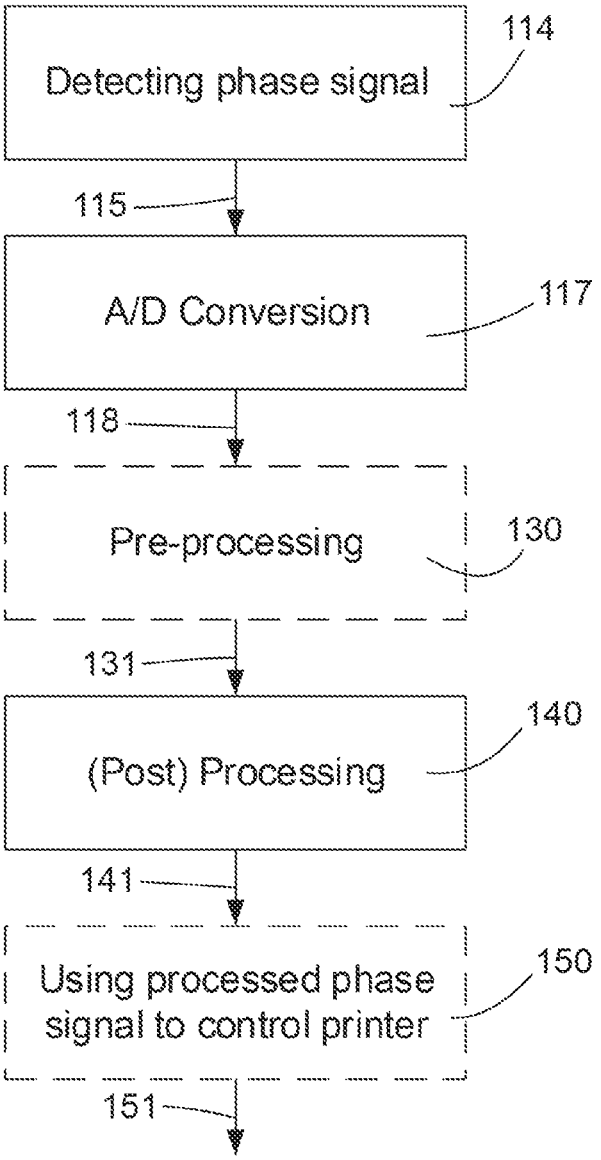
FIG. 2 is a flow diagram representing a related method of processing a phase signal.

FIG. 2 shows a related method of processing phase signals.

At least one analogue phase signal is initially measured 114 by the phase sensor 14 and made available 115 (directly or indirectly, as the case may be) to an A/D converter 17 which converts it 117 into a digitised phase signal. The phase sensor 14 may perform analogue gain (e.g. amplification) and signal conditioning prior to digitisation.

The digitised phase signal is then optionally inputted 118 to a pre-processor 30 for pre-processing 130 (e.g. to eliminate or reduce background noise).

The pre-processed digitised signal is then transmitted 131 to the main processor 40 for processing 140 (or post-processing, if the optional pre-processing 130 is also carried out). The processor 40 produces the required phase data and these phase data are outputted 141 by the processor 40 and routed to the controller 50 which may use them to control 150 the inkjet printer 1 over a communication network 151.

Figure 3:
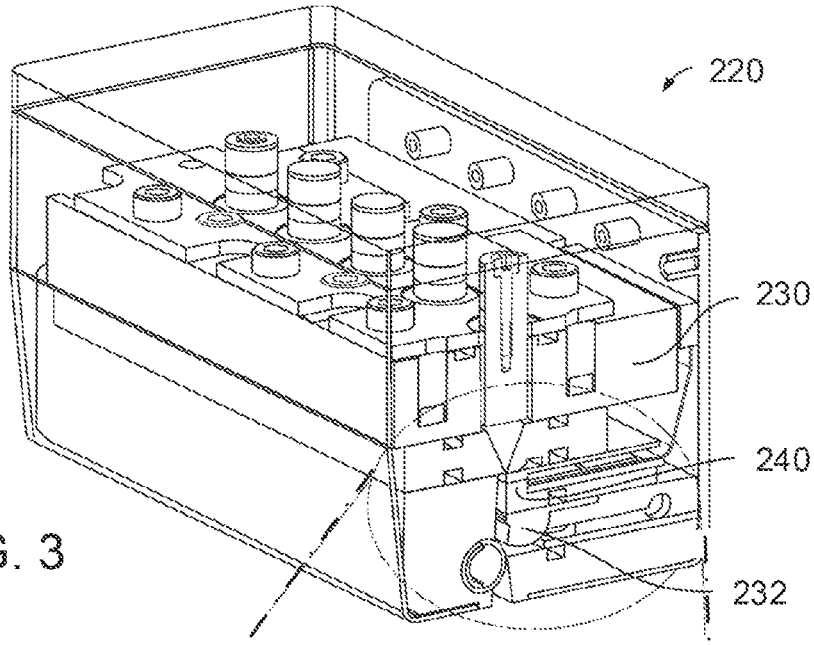
FIG. 3 is a sectional view (with the outer cover transparent) of a portion of a binary array printhead according to an embodiment of the present invention.
Figure 3A:
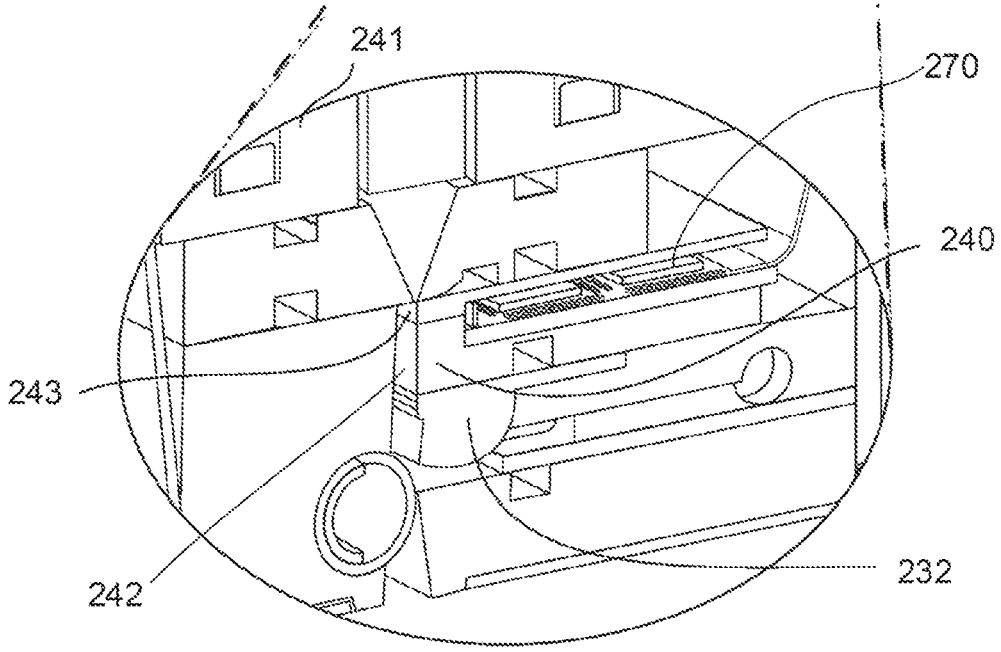
FIG. 3A is an enlargement of a part of FIG. 3 above.

FIGS. 3 and 3A show a binary array inkjet printhead 220 according to an embodiment of the present invention. The printhead 220 includes a drop generator 230 comprising a plurality of nozzles, a charge electrode assembly 240, a gutter 232 and an ink cavity 241. Other components of the printhead 220, such as the piezoelectric actuators, are shown but have not been labelled.

Figure 4:
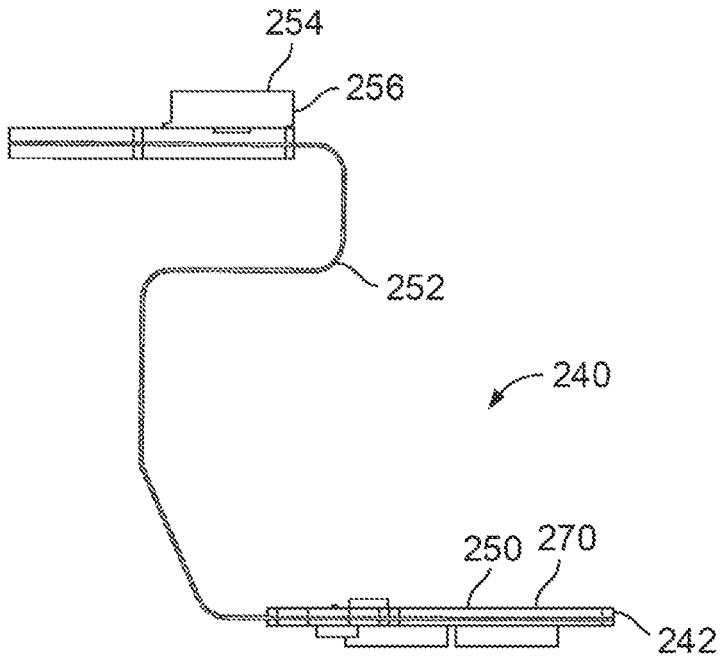
FIG. 4 is a side view of the charge electrode assembly of FIGS. 3 and 3A above, with a ceramic carrier removed.
Figure 5:
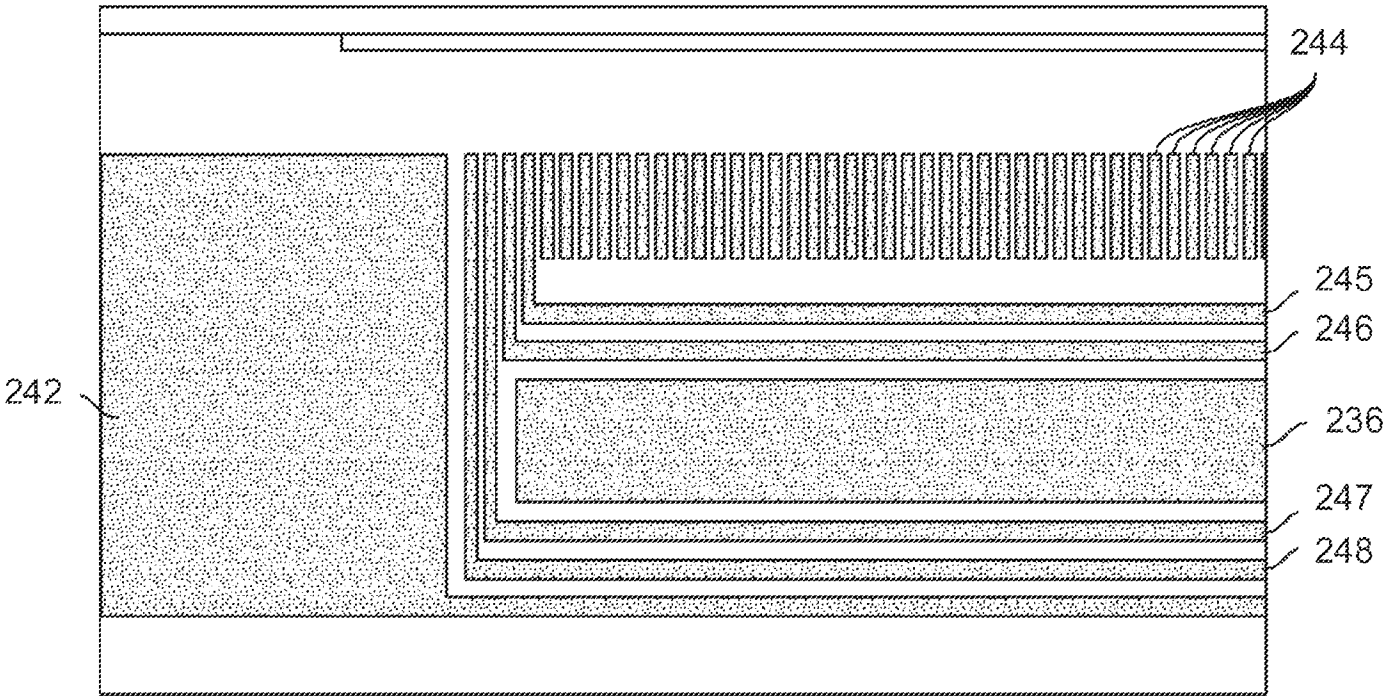
FIG. 5 is a front view of the charge electrode assembly of FIGS. 3, 3A and 4 above.
Figure 6:
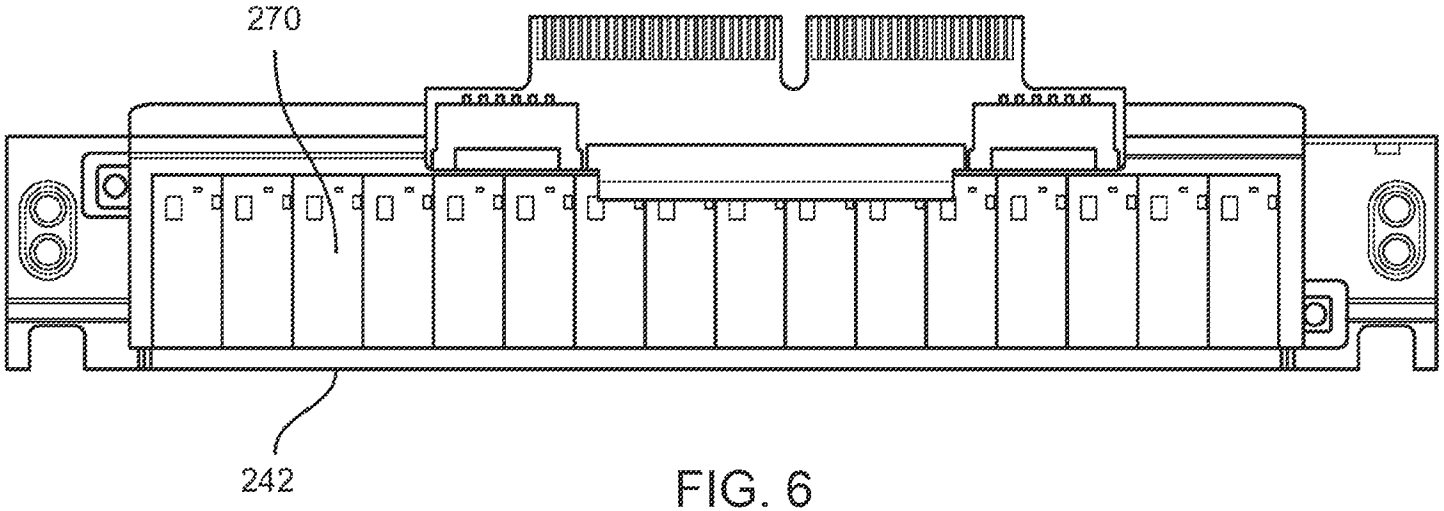
FIG. 6 is a top view of the charge electrode assembly of FIGS. 3-5 above with most of the ceramic carrier removed to reveal embedded electronics.

With reference to FIGS. 4-6, the charge electrode assembly 240 comprises multiple charge electrodes 244, one for each orifice 243 of the droplet generator 230. In this embodiment, the charge electrode assembly 240 is of compact design since electrode electronics 270 is disposed on the charge electrode assembly 240. However, alternative designs may create the required drive signals for the charge electrodes 244 remote from the charge electrode assembly 240 and thus require a long flexible circuit (not shown) between the remote drive circuitry and the charge electrodes 244. In either case, capacitive coupling between the leads conducing to the charge electrodes 244 may introduce significant crosstalk on adjacent channels. Embodiments of the present invention may enable satisfactory phasing to be performed even in the presence of significant crosstalk.

FIG. 4 is a side view of the charge electrode assembly 240 shown in FIGS. 3 and 3A. The locations of the front face 242 and electronic circuitry 270 of the charge electrode assembly 240 are shown in both in FIGS. 3A and 4 and as such illustrate how the electrode assembly 240 is installed in the printhead 220.

As best shown in FIG. 5, the charge electrode assembly 240 has a front face 242 configured to be disposed generally parallel to a plurality of paths of ink droplets emanating from the orifices 243 of the droplet generator 230. Thus, the face 242 of the charge electrode assembly 240 is disposed along the length of the array of nozzle orifices 243. The plurality of charge electrodes (or tracks) 244 are disposed on the front face 242. The charge electrodes 244 include conductive material disposed on and between insulating materials such as ceramic. The electrode tracks 244 may be each about 100 micron to 200 micron wide. The orifices, it will be understood, are spaced accordingly in this embodiment. Each charge electrode 244 corresponds to a drop path from the array of orifices 243 and is oriented generally parallel to the drop path. The charge electrodes 244 may be generally flat, but alternative shapes are possible. The front face 242 of the charge electrode assembly 240 further includes one or more sensor electrodes disposed on the front face 242 and oriented generally perpendicular to the drop paths. As shown in FIG. 5, in this embodiment, the charge electrode assembly 240 includes four sensor electrodes 245, 246, 247, 248, and a deflection electrode 236 disposed laterally across the drop paths. The sensor electrodes 245, 246, 247, 248 perform the function of the phase sensor 14 described above with reference to FIG. 1. The sensor electrodes 245 246, 247, 248 may be arranged as differential pairs with electrodes 245 and 246 forming a first pair and electrodes 247 and 248 forming a second pair. This arrangement of differential pairs of electrodes allows a zero crossing point to be created at each pair, enabling a transit time of a droplet between the electrode pairs to be more accurately determined. During use, each jet (that is, a jet originating from a particular one of the array of orifices 243) may be initially charged at a predetermined level. During subsequent operation, voltage reductions may be applied on a per jet (or group of jets) basis, and this change in charge level can be detected by the sensor electrodes and extracted from a background signal by digital signal processing, allowing signals detected by the sensor electrodes to be associated with droplets originating from particular ones of array of orifices.

As described above, sensors may be used to measure a number of characteristics of the ink drops including their phase and/or velocity. At least two sensors may be provided for detecting velocity and/or phase of the droplets. In the embodiment described above, the deflection electrode 236 is disposed between pairs of the sensor electrodes, with sensor electrodes 245, 246 disposed upstream of the deflection electrode 236 and sensor electrodes 247, 248 disposed downstream of deflection electrode 236.

Of course, it will be understood that alternative electrode arrangements can be used. For example, one pair of electrodes may be omitted, and/or signal electrodes may be used (i.e. rather than pairs of electrodes).

The charge electrode assembly 240 includes a charge electrode block portion 250 disposed between the droplet generator 230 and the gutter 232, with the electronic circuitry 270 being disposed on said charge electrode block portion 250. A flexible connector circuit 252 is also provided to connect between the charge electrode block portion 250 and a portion 254 of the electrode assembly including modulation signal connectors 256. Of course, other configurations are possible. Block portion 250 may also include an insulator plate (not shown) and cleaning fluid channel (not shown).

FIG. 6 shows the charge electrode assembly 240 of FIGS. 3-5 described above with most of the ceramic carrier removed to show the embedded electronics 270. As shown in FIG. 6, the electronic circuitry 270 is disposed on a planar portion of the electrode assembly 240 behind the front face 242. However, as previously mentioned, in other designs the electronic circuitry 270 for the charge electrodes 244 is disposed remote from the charge electrode rather than adjacent to it.

The electronic circuitry 270 may generally be in the form of a Printed Circuit Board (PCB) with integrated circuits and discrete components. The electronic circuitry 270 provides the drive signals to apply drop charging pulses to the charge electrodes 244, at the correct timing relative to the drop generation clock. In essence, the electronic circuitry 270 provides the switches to determine which charge electrode 244 is to be charged at a given time. Each electrode 244, 245, 246, 247, 248, is electrically connected to the electronic circuitry 270. The electronic circuitry 270 is further in electrical connection with an electrical connection line for further connecting the electrode assembly 240 to a controller (such as the controller 50 of FIG. 1) for controlling the printhead 220.

In the described embodiment, an A/D converter is provided as part the printhead 220. The A/D converter is disposed on the electric path between the charge electrode assembly 240 and the controller and it is arranged to digitise the phase signals in preparation for their processing. Alternatively, the A/D converter may be provided separately from the printhead, for example as part of a separate controller 50 as shown in FIG. 1. This may be the case when the controller 50 is embodied by a separate processor or computer.

Examples of phasing processes for continuous inkjet printers in accordance with the present invention are further described below.

Figure 7:
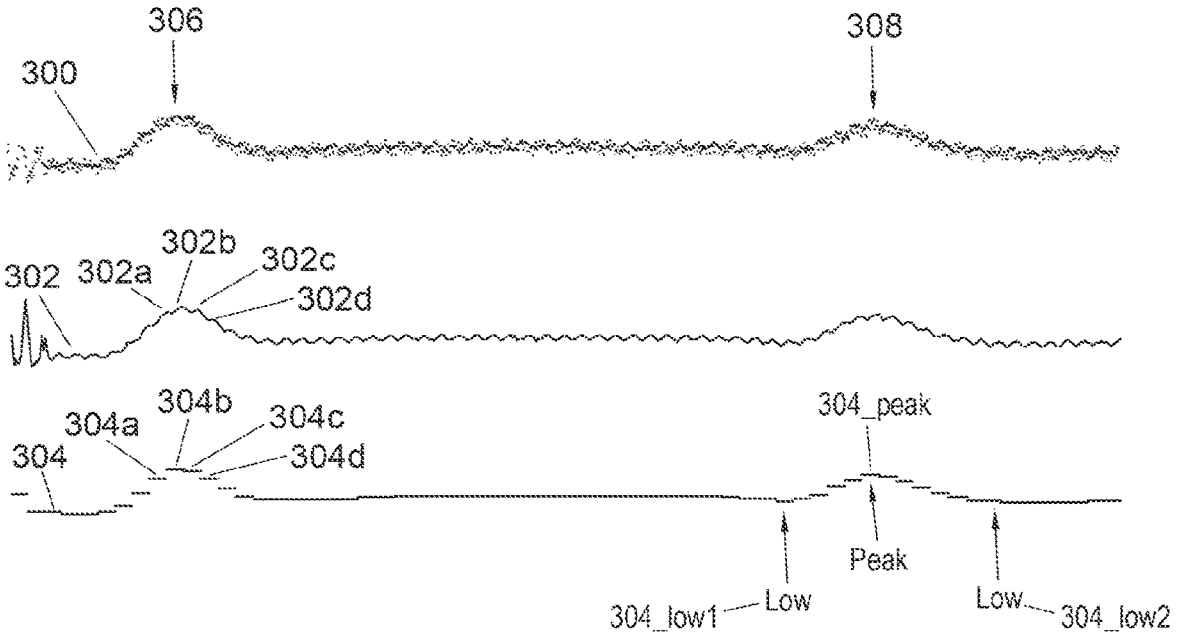
FIG. 7 shows example waveforms processed by a method according to the present invention.

FIG. 7 illustrates an example of a phasing signal at various stages of processing performed by the above described apparatus. A raw phasing signal 300 is shown as a first trace in FIG. 7 part (a). An averaged phasing signal 302 is shown as a second trace in FIG. 7 part (b). A modulation averaged phasing signal 304 is shown as a third trace in FIG. 7 part (c). In each of the illustrated signals, the vertical position is indicative of signal amplitude, while the horizontal position is indicative of time (increasing from left to right).

It can be seen that the raw phasing signal 300 includes a significant amount of noise or jitter. It can, however, also be seen that there are two clear peaks 306, 308 within the time period shown. Corresponding peaks are visible in each of the three signals 300, 302, 304.

The averaged phasing signal 302 is generated from the raw phasing signal 300 by averaging the raw phasing signal 300 in time. Such averaging may be performed by a digital equivalent of low-pass filter, which may be performed, for example, by pre-processor 30. The averaged phasing signal 302 clearly exhibits a relatively high-frequency component (as compared to the frequency of the peaks 306, 308) which is superimposed on top of the main signal having peaks 306, 308. The high-frequency component has approximately 10 full oscillation cycles during the duration of each of the peaks 306, 308. This higher-frequency component is understood to correspond to the frequency of the modulation waveform used for actuating the piezoelectric elements of the printhead for generating ink droplets. Local maxima associated with this modulation frequency are indicated during the peak 306 as sub-peaks 302*a*-302*d*. It will be appreciated that the averaging performed to generate the averaged phasing signal 302 should have an averaging window which is shorter than the superimposed modulation period (e.g. performing a similar function to a low-pass filter having a cut-off frequency which is greater than (or at least equal to) the modulation frequency).

The modulation averaged phasing signal 304 is derived from the averaged phasing signal 306, but further averaged within each modulation period. Thus, an average value is generated which is maintained for the duration of each modulation period, with a new average value being generated for the subsequent modulation period. Thus, for each of the local maxima 302*a*-302*d* within the averaged phasing signal 302, there is a corresponding modulation averaged value 304*a*-304*d* of the modulation averaged phasing signal 304. In this way, it is possible to obtain a value of the phasing signal which is indicative of the average signal within each modulation period, thereby eliminating any noise that is synchronous with the modulation signal.

Moreover, it is possible to perform further processing on the modulation averaged phasing signal 304 so as to generate data indicative of particular characteristics of the droplets passing the phase sensor 14. For example, as illustrated with reference to the peak 308 in waveform 304, by identifying a peak value 304_peak and first and second low values 304_low1 and 304_low2 either side of the peak value 304_peak, it is possible define a 'response value' as the difference between the peak value 304_peak and an average of the first and second low values 304_low1, 304_low2. Such a response value can be understood to be indicative of the maximum phase signal amplitude fluctuation caused by a droplet travelling past the phase sensor 14. Of course, a response value could be defined in different ways (e.g. with reference to only one of the low values, or with reference to a longer term average or minimum value).

The processing described above with reference to FIG. 7 is all carried out digitally in the temporal domain. While various parts of this processing could be carried out by analog circuitry (e.g. low-pass filtering) it will be appreciated that it is preferable to digitise the entire signal at a conversion resolution which allows sufficient detail to be extracted. Such processing provides many advantages. For example, since crosstalk generated from the modulation signal can be many times greater in amplitude than the phasing signal itself, using a simple filter may not enable the phasing signal to be extracted. By using the digital methods described above, it is possible to extract signals having a far lower magnitude than band pass filter methods (as currently used). Additionally large band pass filter components are also not required.

By way of further explanation of the use of time-domain phase signals as opposed to frequency domain phase signals FIG. 8*a* illustrates a processing sequence which uses both frequency domain and time-domain processing, whereas FIG. 8*b* illustrates a purely time domain processing sequence.

In FIG. 8*a* analogue input signals 400 are processed in the frequency domain by amplifiers 402, filters 404, and comparators 406. The comparator output is then passed to an input of an FPGA 410 for processing, and then passed on to a CPU 412 for further processing. The amplifiers 402, filters 404 and comparators 406 operate in the frequency domain, whereas the FPGA 410 and CPU 412 operate in the time domain. In such an arrangement, the phase processing performed in the analogue domain by amplifiers 402, filters 404, and comparators 406 may require an extremely high signal to noise ratio to be performed to an acceptable level.

On the other hand, in FIG. 8*b*, equivalent analogue input signals 420 are processed by a differential amplifier 422 before being passed to an ADC 424, and then on to an FPGA 426 and CPU 428 to perform the rest of the processing. All of these processing steps are carried out in the time domain.

In the situation illustrated in FIG. 8*a*, where frequency domain processing is applied, a number of analogue signal operations are used for the cancellation of any unwanted signals and for the detection of the phasing pulses (e.g. by the amplifiers, filters and comparators), before the signal is then passed into the digital domain. However, it will be understood that such identification of the relevant parts of the signal, which may be required for further processing, can result in certain signal features being lost during the frequency domain processing. That is, the use of appropriate filters and comparators which can identify features of interest may also reject some signal features which could be of significant value if passed through the subsequent processing steps.

However, by using an entirely digital processing sequence, the raw analogue signals can be immediately converted into the digital domain, and then processed digitally in the time domain.

This process is now further described with reference to FIG. 9. In FIG. 9 part (a) a timeline 460 is shown, which illustrates schematically the origins of various signal components which may be detected by the sensor 14 (e.g. sensor electrodes 245, 246, 247, 248) during the progress of a single droplet from the nozzle 11 (e.g. one of orifices 243) past the charge electrodes 13 (e.g. one of electrodes 244), the phase sensor 14 (e.g. sensor electrodes 245, 246, 247, 248), and deflection electrodes 15 (e.g. electrode 236).

During a first time period T1, the droplet is passing from one of the orifices 243 towards the charging electrodes 244. During a second time period T2 the droplet is passing over the charge electrodes 244 and is being charged (depending on whether or not the droplet is required to be charged). During a third time period T3 a droplet is passing over the upper sensor electrodes 245 and 246. During a fourth time period T4 the droplet is passing over the deflection electrode 236. Then, in a fifth time period T5 the droplet is passing over the lower sensor electrodes 247, 248. Finally, in a sixth time period T6 the drop is proceeding away from the charge electrode assembly 240.

When the droplet is passing over the upper and lower sense electrodes 245 to 248 (i.e. during periods T3 and T5) the phase sensor 14 is ideally operable to sense the passage of the drops. However, it will also be understood that during periods before the time at which the droplet is passing over the electrodes 245, 246 of the phase sensor 14 (i.e. during time periods T1, T2) and also after the droplet has passed away from the electrodes 247, 248 of the phase sensor 14 (i.e. during time period T6), the sensor 14 will only be picking up noise and various interference sources. Noise may be generated, for example, by different components of the printer (e.g. during printing or switching).

FIG. 9 part (b) illustrates the use of analogue filters which are typically used in prior art printers to distinguish between a period of interest 460 and periods 462, 464 which should preferably be disregarded. It will be understood that due to the inability to accurately discriminate between different time periods in the frequency domain, signals captured during time periods T1, T2 and T6 may also be used in subsequent processing to some extent in addition to the signals capture during time periods T3, T4 and T5. Of course, the signal selection process may cause such signals to be attenuated to a varying degree. However, even in the main time window of interest (e.g. at times T3 to T5) during which the passage of a droplet is observed at the sensor electrodes 235, 246, 247, 248, the signal obtained may be affected to some extent by the subsequent and preceding signals. The signal sensitivity during the centre of period 460 is maximised, while during periods 462, 464 the signal sensitivity is reduced (i.e. attenuation is increased). The signal sensitivity of the analogue selection circuitry is shown schematically by the different hatching between regions 460, 462, 464, with denser hatching (representing higher signal sensitivity and lower density hatching representing lower signal sensitivity. However, rather than the sensitivity changing abruptly between the periods 462 and 460, and between the periods 460 and 464, the sensitivity gradually increases, and then gradually decreases.

On the other hand, as illustrated in FIG. 9 part (c), when digital phasing is used and processing is carried out entirely in the time domain, it is possible to accurately discriminate between time periods for which the signals are processed, and time periods for which the signals are to be ignored. For example, it will be possible to configure the digital processing system to substantially ignore the signals obtained during time periods T1 and T2 and T6 (regions 472, 474) and to exclusively process the signals obtained during time periods T3, T4 and T5 (region 470). In this way it is possible to focus accurately on the periods of interest and to disregard any signals which are captured from outside the time period of interest. Hatching density is again used to represent signal sensitivity in a similar manner to FIG. 9 part (b).

As described above the use of time domain digital signal processing as compared to frequency domain analogue signal processing allows a number of additional benefits to be realised when processing phasing signals. For example, when processing signals in the frequency domain the processing is typically (and often necessarily) optimised for the detection of phase differences. However, it may not always be possible to additionally accurately detect alternative features, since there may not enough time resolution to identify anything other than the most obvious signal features. For example in some instances some change to the geometry or the drive signals provided to the charge electrodes can cause an observable change in the phasing signal. However, in some instances such changes may not be readily detectable when using frequency domain processing.

FIG. 10 illustrates one such possible change in phasing signals. A graph is shown in which the vertical axis represents signal amplitude and the horizontal axis represents time. It can be seen that a first signal 490 rises from a brief low 490*a* to a peak 490*b* and then falls back to a second low 490*c*. An alternative signal 492 rises from a broader low 492*a* to a similar peak 492*b* (i.e. similar to peak 490*a*) and falls to a similar low 492*c*.

However, a rising edge 490*d* of the phasing signal 490 is noticeably different than the rising edge 492*d* of the phasing signal 492. That is, while the signal peak times and peak heights are very similar, the rising edge shapes are quite noticeably different. In frequency domain processing, it may be difficult to properly distinguish between these two different wave forms unless extremely high frequencies are taken into account. However by using the digitised processing described above, and by processing in the time domain, it is possible to discriminate between the two signals described above with relative ease.

A further advantage of using digitised signals rather than analogue signals may be found where phasing signals received are particularly weak. When using analogue processing, it may be necessary to use multiple jets in order to improve the signal to noise ratio. However, when digital phasing signals are used, the time averaging process described above can be used to improve signal to noise ratio (for example as illustrated in FIG. 7).

It will be appreciated therefore that the use of digital signal processing as opposed to analogue signal processing allows a plurality of additional benefits to be realised. For example, by averaging in time in the digital domain, rather than applying a low-pass filter in the analogue domain, events occurring before the processing window do not affect the results during the phasing period being monitored. In analogue processing, the output can be influenced by such unwanted signals from outside of the window of interest. For example, if a signal provided to the printhead heater creates a pulse on the input to phase circuitry a few microseconds before the time when a real phase signal is expected to occur, the output of the phasing circuit would most likely be oscillating at a time when it is required to resolve the detected phase signal. Such interference can reduce the accuracy of detected signals, unless extremely high frequencies are taken into account in the analogue domain (to enable a sharp cut-off window).

As noted above in some embodiments the method may include extracting one or more phase parameters from the captured phase signal. Such phase parameters may include (but are not limited to) parameters which are extracted for each jet, and also parameters which are extracted for all jets.

Furthermore some parameters may be generated which are the result of a comparison between a present value of the phasing signal and a previously obtained value of phasing signal.

A parameter which may be determined for each jet is a response value obtained from the upper and/or lower sensor electrodes. A response value may be defined as the difference in phase signal amplitude between a detected peak and a low value detected either side of the peak. Of course alternative definitions of a response value may be determined.

A further parameter which may be determined for each jet is an upper and/or lower differential response value. For example, such a differential response value may be obtained by determining a response value for each of an upper and lower sensor electrode and generating some form of difference value between the two obtained response values.

A further parameter which may be determined for each jet is a measure of absolute phase. Such a parameter may be used to provide an indication of a break-up position of the jet in a "tooth". A tooth may be considered to be equivalent to one of the electrode pads 244 shown in FIG. 5, which shows a planar electrode structure. However, in alternative embodiment, the conductive pad may be contained within a slit ceramic structure, which may be configured to provide electrical isolation between adjacent jets. Such a structure is described in U.S. Pat. No. 5,561,452.

A further parameter which could be determined for each jet is a difference between a jet phase response and the mean phase response. In this way, it is possible to monitor the phase of individual jets relative to the mean in the array. Any significant deviation away from the mean may provide an early indication of potential failure e.g. that a jet is starting to deviate.

A parameter which can be determined from the phasing signals for all jets may, for example, be a phase response average value. Such an average value may be a response value as (as defined above) averaged over a number of parallel jets.

A further parameter which could be determined for all jets may be a parameter indicative of the extent to which the ink jets are parallel to the charge electrodes. Such a parameter may be obtained by comparison of an individual jet response to an average jet response. Such deviation is illustrated in FIGS. 11*a*-11*c*, in which FIG. 11*a* illustrates the amplitude of phase signals obtained from the upper and lower track sensor electrodes in the case where there is a parallel jet. However, as shown in FIG. 11*b*, if a signal from the lower sensor electrodes is lower in amplitude than the signal from the higher electrodes it may suggest that the jet is skewing away from the plate. Conversely, as shown in FIG. 11*c*, if a signal from the lower sensor electrodes is higher in amplitude than the signal from the higher electrodes it may suggest that the jet is skewing towards the plate.

Finally, a parameter which may be derived which is indicative of a comparison between recently obtaining signal values and previously obtained phasing signal values may include a parameter indicative of a response change caused by skews or ink build ups. Such a parameter may be obtained by comparison of each jet's current phase response relative to its phase response in a start-up state.

Embodiments of the invention have been described above with reference to the appended Figures in a non-limiting manner, i.e. purely by way of example. As it will be recognised by the skilled person, many more embodiments are possible within the scope of the appended claims.

The invention claimed is:

1. A method of processing phase signals for continuous inkjet printing, said method comprising:

generating at least one phase signal, wherein said at least one phase signal is an analogue signal;

converting the at least one phase signal into at least one corresponding digitised phase signal; and processing said at least one digitised phasing signal, wherein the processing comprises extracting at least one predetermined phase parameter from the at least one digitised phasing signal when the at least one digitised phasing signal is a time-domain digitalised phase signal, and wherein the at least one predetermined phase parameter comprises one or more time-domain signal features of the at least one digitised phasing signal, wherein the processing said at least one digitised phasing signal comprises:

identifying a peak in said at least one digitised phasing signal;

generating predetermined phase parameters associated with said identified peak;

generating a response value associated with said identified peak, said response value comprising data indicative of a difference between a first amplitude value during said peak and a second amplitude value before and/or after said peak;

identifying a second peak in said at least one digitised phasing signal;

generating a second response value associated with said second identified peak; and generating a differential response value, said differential response value comprising data indicative of a difference between said response value and said second response value.

2. A method according to claim 1, wherein the analogue phase signal is a time-domain phase signal.

3. A method according to claim 1, wherein the at least one digitised phase signal is a time-domain digitised phase signal.

4. A method according to claim 1, wherein the method further comprises pre-processing said at least one digitised phase signal, wherein said pre-processing said at least one digitised phase signal comprises conditioning the at least one digitised phase signal according to any one or more of the following digital signal conditioning operations: filtering; smoothing; rectifying: averaging; amplifying; and/or gating.

5. A method according to claim 4, wherein said pre-processing comprises generating an averaged phase signal, said generating comprising averaging the digitised phase signal so as to remove signal components above a predetermined cut-off frequency.

6. A method according to claim 4, wherein said pre-processing comprises generating a modulation averaged phase signal, wherein said modulation averaged phase signal comprises a fixed vale for each period of a droplet generation modulation signal.

7. A method according to claim 1, wherein said one or more time-domain signal features comprise any one or more of: a peak; a trough; a threshold; a derivative; a differential; an integral; a power; an average; and a window.

8. A method according to claim 1, wherein said response value and said second response value are associated with different sensing locations.

9. A method according to claim 1, wherein said processing the at least one digitised phase signal comprises generating data indicative of a droplet break-up location.

10. A method according to any-preceding-claim 1, wherein said processing the at least one digitised phase signal comprises:

comparing the at least one digitised phase signal to a reference signal; and identifying a difference between said at least one digitised phase signal and said reference signal.

11. A method according to claim 1, wherein two or more analogue phase signals, a plurality of analogue phase signals or a large plurality of analogue phase signals, are provided, each corresponding to an ink jet of a multi-jet continuous inkjet printer.

12. A method according to claim 11, wherein said processing the at least one digitised phase signal comprises:

combining data associated with a plurality of digitised phase signals corresponding to a respective plurality of ink jets.

13. A method according to claim 11, wherein said processing the at least one digitised phase signal comprises:

comparing data associated with a first digitised phase signal corresponding to a first ink jet to data associated with one or more further digitised phase signals corresponding to one or more further ink jets.

14. A method according to claim 1, wherein said processing the at least one digitised phase signal comprises generating data indicative of a relationship between a charge electrode property and an ink jet property.

15. A method of phasing a continuous inkjet printer, a multi-jet printer or a binary array printer comprising a method according to claim 1.

16. An apparatus for continuous inkjet printing comprising:

a printhead comprising one or more printing orifices for emitting one or more ink jets;

one or more phase sensors configured to measure one or more analogue phase signals associated with the one or more ink jets;

an analogue-to-digital converter, wherein said analogue-to-digital converter is arranged to convert said one or more analogue phase signals into corresponding one or more digitised phase signals; and a processor configured to process said one or more digitised phase signals to extract at least one predetermined phase parameter when the one or more digitised phasing signals are time-domain digitalised phase signals, and wherein the at least one predetermined phase parameter comprises one or more time-domain signal features of the digitised phasing signals;

wherein the processor is configured to:

identify a peak in said at least one digitised phasing signal;

generate predetermined phase parameters associated with said identified peak;

generate a response value associated with said identified peak, said response value comprising data indicative of a difference between a first amplitude value during said peak and a second amplitude value before and/or after said peak;

identify a second peak in said at least one digitised phasing signal;

generate a second response value associated with said second identified peak; and generate a differential response value, said differential response value comprising data indicative of a difference between said response value and said second response value.

17. Apparatus according to claim 16, wherein the one or more phase sensors comprise at least one charge-pickup electrode arranged to sense a charged droplet.

18. Apparatus according to claim 17, wherein said charge-pickup electrode is arranged to sense a transit of said charged droplet alongside said charge-pickup electrode.

19. Apparatus according to claim 16, wherein the printhead is a multi-jet printhead comprises two or more printing orifices.

20. A continuous inkjet printer comprising an apparatus according to claim 16.

* * * * *